United States Patent [19]

Horiuchi

[11] Patent Number: 5,042,180

[45] Date of Patent: Aug. 27, 1991

[54] PICTURE FRAME OF SYNTHETIC RESIN

[75] Inventor: Shiro Horiuchi, Osaka, Japan

[73] Assignee: Sekisui Jushi Kabushiki Kaisha, Osaka, Japan

[21] Appl. No.: 410,431

[22] Filed: Sep. 21, 1989

[51] Int. Cl.[5] ..... G09F 1/12

[52] U.S. Cl. ..... 40/155; 40/152; 40/156

[58] Field of Search ..... 40/152, 152.1, 155, 40/156, 154, 158.1, 603

[56] References Cited

U.S. PATENT DOCUMENTS

| | | | |
|---|---|---|---|
| 1,762,083 | 6/1930 | Singer, Jr. | 40/154 |
| 2,737,742 | 3/1956 | Leigh | 40/155 |
| 2,762,148 | 9/1956 | Alcaraz | 40/155 |
| 3,546,802 | 12/1970 | Preston | 40/152 |
| 4,132,018 | 1/1979 | Hughes | 40/152.1 |
| 4,237,631 | 12/1980 | Moe et al. | 40/152.1 |
| 4,237,632 | 12/1980 | Segerstad | 40/156 |
| 4,498,255 | 2/1985 | Heard | 40/152 |
| 4,512,094 | 4/1985 | Seely | 40/156 |
| 4,519,152 | 5/1985 | Seely | 40/156 |
| 4,523,400 | 6/1985 | Seely | 40/156 |
| 4,702,025 | 10/1987 | Mace | 40/152.1 |
| 4,922,638 | 5/1990 | Litvak et al. | 40/154 |

FOREIGN PATENT DOCUMENTS

| | | | |
|---|---|---|---|
| 2087121 | 5/1982 | United Kingdom | 40/152 |
| 2104378 | 3/1983 | United Kingdom | 40/155 |

*Primary Examiner*—Kenneth J. Dorner
*Assistant Examiner*—Brian K. Green
*Attorney, Agent, or Firm*—Armstrong, Nikaido, Marmelstein, Kubovcik & Murray

[57] ABSTRACT

A picture frame molded in one piece from synthetic resin which includes a back plate for supporting a sheet to be framed on its face side, a plurality of frame members disposed along marginal portions of the back plate and being rotatable about respective hinge portions to constitute a front frame work when turned toward the face side of the back plate, each of the frame members having a pressor member formed at its free end and adapted to hold the sheet in association with the face side of the back plate when the frame member is turned toward the face side of the back plate, and locking elements each comprising a male member and a female member, one of which is disposed on the inner side of the frame member or of the pressor member, with the other being disposed on a marginal portion of the back plate in the position corresponding to the one of the male and female members, whereby the frame members are secured on the sheet set on the face side of the back plate.

5 Claims, 4 Drawing Sheets

PICTURE FRAME OF SYNTHETIC RESIN

BACKGROUND OF THE INVENTION

1. Field of the Invention

The present invention relates to a picture frame molded in one piece from synthetic resin and adapted to hold a sheet to be framed, such as a photograph, picture card, poster, drawing, letter of citation or the like.

2. Description of the Prior Art

A conventional picture frame generally comprises a rectangular framework of wood, aluminum, synthetic resin or other material, a back plate or board for supporting a sheet such as a photograph thereon, and a plurality of lock devices, generally made of metal, pivotally attached to the reverse side of the framework. To set a photograph or the like in the picture frame, a transparent sheet and the photograph or the like are fitted into the framework in that order and, after the back plate is set in position, the lock devices are turned inward to firmly hold the assembly in position.

However, since this conventional picture frame must be fabricated by assembling several discrete structural members, a problem arises in that the manufacturing and assembling process is time-consuming and labor-consuming. Moreover, it takes considerable time to set a photograph or the like in the picture frame or take it out of the frame.

SUMMARY OF THE INVENTION

It is an object of the invention to provide a picture frame of synthetic resin such that the mounting and dismounting of a transparent sheet and a photograph or the like can be accomplished merely by rotating the frame members.

It is another object of the invention to provide a picture frame of synthetic resin with which a photograph or the like can be firmly secured and maintained in the proper position.

It is a further object of the invention to provide a picture frame of synthetic resin such that the rotation of the frame members is easy and smooth with snap-on sounds produced when the frame members are locked in place.

The above and further objects, features and advantages of the invention will become more fully apparent from the following description with reference to the accompanying drawings. It is to be expressly understood, however, that the drawings are for purposes of illustration only and are not intended as a definition of the limits of the invention.

DETAILED DESCRIPTION OF THE PREFERRED EMBODIMENTS

The picture frame according to the present invention is manufactured in one piece by the injection molding of a synthetic resin material. As examples of the resin material, polypropylene, polyethylene, polyvinyl chloride, polystyrene, nylon, etc., may be used, although polypropylene is particularly preferred from the standpoint of durability and economics.

Figure 2:
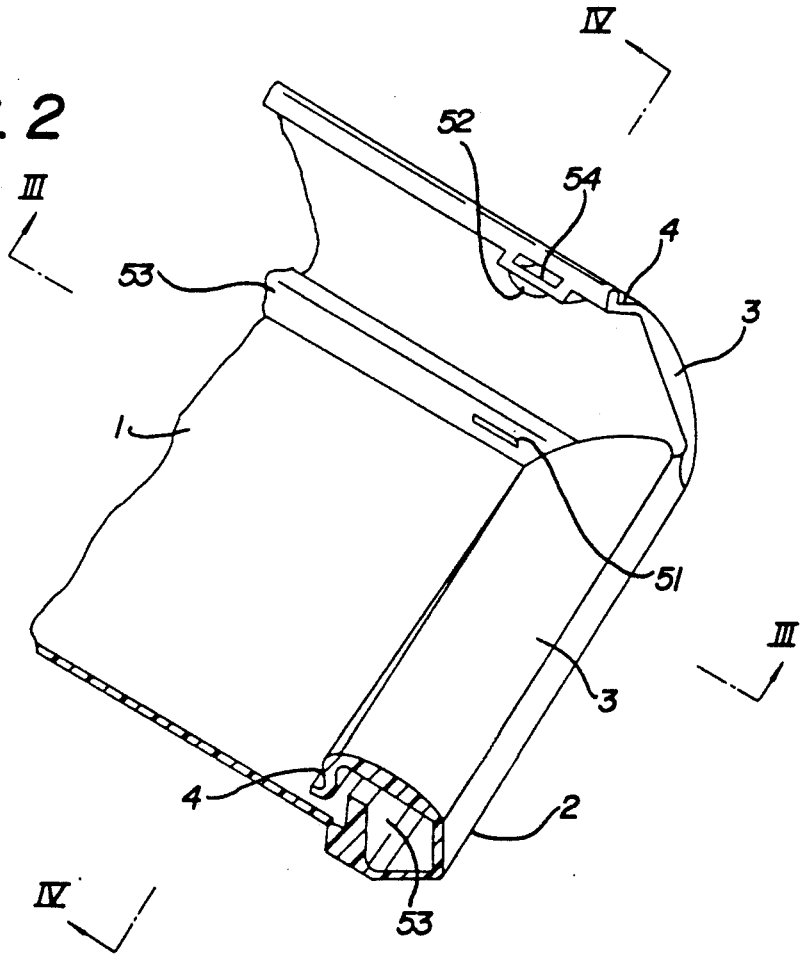
FIG. 2 is a partial perspective view showing a preferred embodiment of the invention.

One preferred embodiment of the invention is described below, referring to FIGS. 2 through 4.

The picture frame according to this embodiment comprises a rectangular back plate 1 for carrying a sheet 6 to be framed, such as a photograph, picture card, poster, drawing, letter of citation or the like, including a protective transparent sheet such as glass; four frame members 3 rotatably connected to the marginal portions of the back plate 1 through hinge portions 2 and adapted to constitute a front framework when turned toward the face side of the back sheet; four pressor members 4 each formed at the free end of the corresponding frame member 3 and adapted to hold the sheet 6 between itself and the back plate 1 when the frame members 3 are turned toward the face side of the back plate; and locking means each adapted to lock the corresponding frame member 3 on the surface of the sheet 6 and back plate 1 when the frame members 3 are turned toward the face side of the back plate 1.

Figure 1:
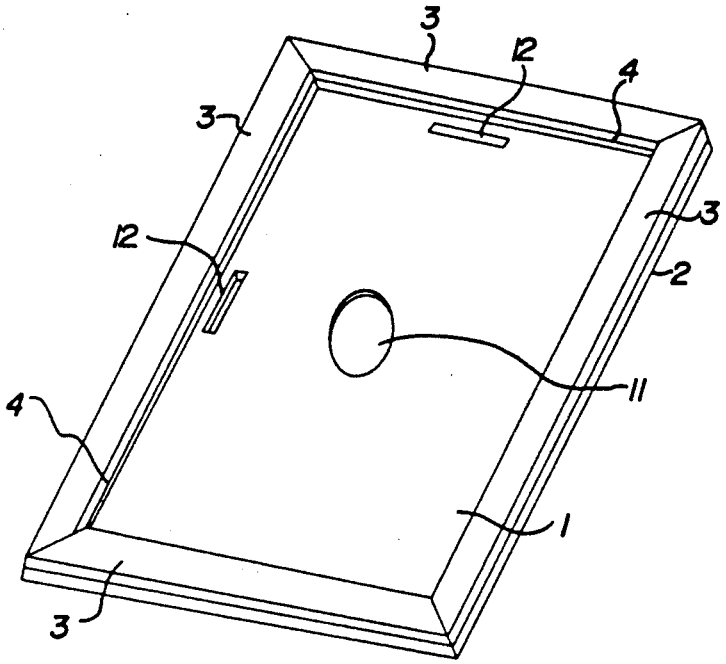
FIG. 1 is a perspective view showing a picture frame of synthetic resin according to the invention.

The back plate 1 is generally rectangular but may be of any other suitable shape such as triangular, pentagonal or other polygonal shape. As illustrated in FIG. 1, the back plate 1 may be provided with a finger-hold opening 11 in an appropriate position for facilitating the mounting and dismounting of the sheet 6 or with a means 12 for accepting a stand (not shown) adapted to provide a free-standing display. Furthermore, the back plate 1 may be provided with one or more reinforcing ribs 13 on its reverse side for improved rigidity and prevention of warping.

As shown, the frame members 3 are integrally connected to the back plate 1 through respective hinges 2. Referring to FIGS. 2 to 4, the frame members 3 are each independently rotatable about the respective hinges 2 and, when turned toward the face side of the back plate 1, constitute the front frame-work of the picture frame (FIG. 1). The hinges 2, as shown, are provided continuously along the four sides of the back plate but they may be discontinuous or discrete and located in strategic positions.

The pressor member 4 is generally formed in a tabular form and integrally with the corresponding frame member 3 at the free end of the latter 3 along the entire length thereof.

The locking means 5 comprises a female element 51 and a male element 52 engageable with the female element 51.

The female element 51 is formed on the inner side (the side facing the center of the back plate) of a projection or raised member 53 disposed along the corresponding side of the back plate 1 in the position corresponding to the free end of the frame member 3 upon rotation of the frame member 3 toward the face side of the back plate 1. It is preferable that a plurality of female members 51 be provided along each edge of the back plate 1. While, in FIG. 2, the female member 51 is configured in the shape of an elongated groove with its longitudinal axis parallel to the length of the raised member 53, it may be otherwise configured or extending along the entire length of the raised member 53.

The male member 52 is formed on the inner side (the side facing the raised member) of the pressor member 4. The male member 52 is disposed in the position corresponding to the female member 51 and configured to be complementary with the female member 51. Furthermore, as shown in FIG. 2, the male member 52 is provided on a projection 54 which is located inwardly of the pressor member 4. In the above arrangement, when the frame member is turned toward the face side of the back plate 1, the pressor member 4 is situated inwardly of the raised member 53 by a distance at least equal to the span of the projection 54 so that the sheet 6 laid on the back plate 1 is effectively retained in position. The above projection 54 is preferably a hollow member which is generally less liable to give raise to a molding strain. The male and female members are so constructed that they can be easily engaged and disengaged by hand. It should be understood that whereas the female member 51 and male member 52 in the above embodiment are formed on the raised member 53 and the pressor member 4, respectively, it may be so arranged that the locking member on the raised member 53 is a male member and the locking member on the pressor member 4 is a female member.

The picture frame described above can be used as follows.

Figure 4:
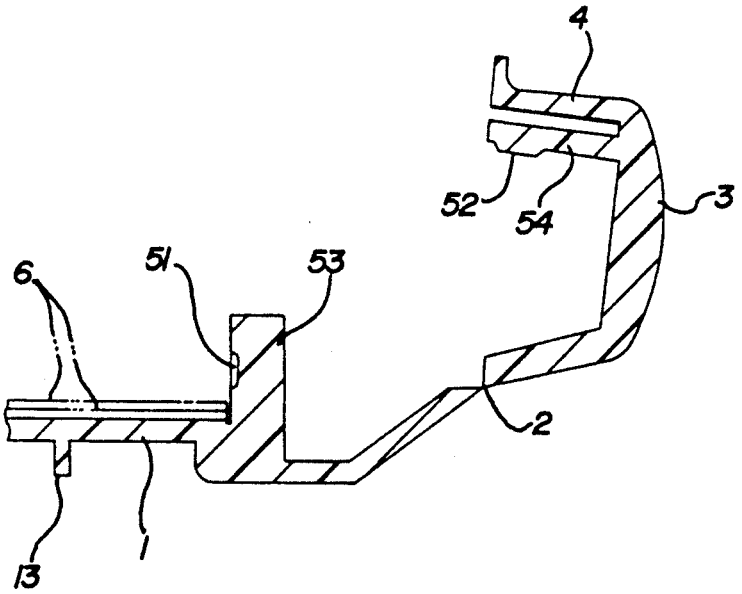
FIG. 4 is a cross-sectional view taken along the line IV—IV of FIG. 2.

Referring to FIG. 4, each frame member 3 is turned outwardly about the respective hinge 2 to disengage the male member 52 from the female member 51 until the face side of the back plate 1 is completely exposed.

Figure 3:
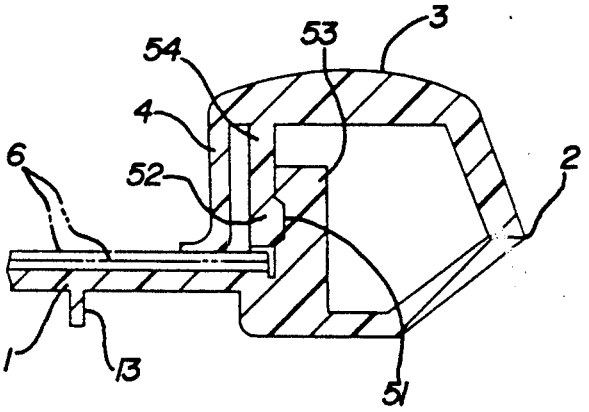
FIG. 3 is a cross-sectional view taken along the line III—III of FIG. 2.

Then, the sheet 6 is set on the face side of the back plate 1 and each frame member 3 is turned in the reverse direction, that is to say toward the face side of the back plate 1 until the male member 52 is reengaged with the female member 51 as shown in FIG. 3. By this procedure the sheet 6 is firmly held by and between the pressor member 4 and the back plate 1.

When the sheet 6 thus mounted is to be removed or exchanged with a different sheet 6, the frame members 3 are opened in the same manner as described above.

Figure 6:
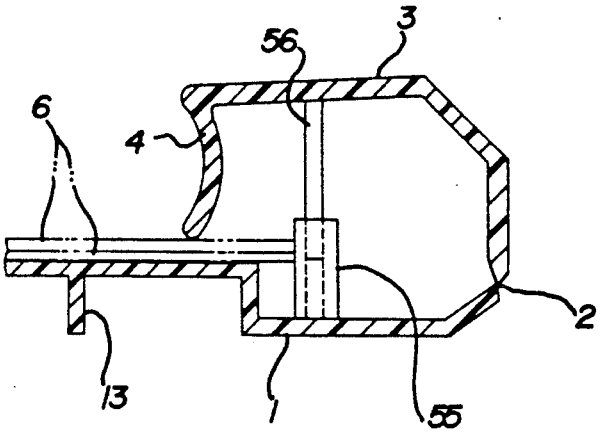
FIG. 6 is a cross-sectional view taken along the line VI—VI of FIG. 5.
Figure 7:
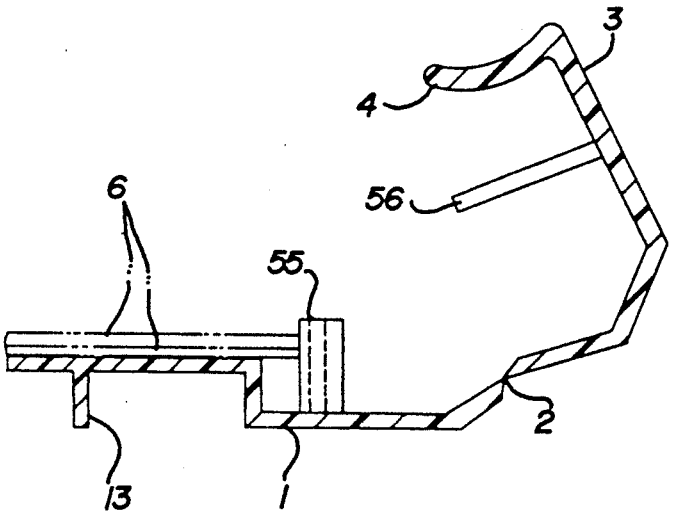
FIG. 7 is a cross-sectional view taken along the line VII—VII of FIG. 5.

Another embodiment of the present invention is described below, referring to FIGS. 5 through 7.

The picture frame according to this embodiment is fundamentally similar to that of the first embodiment except that a different frame locking means is employed. Therefore, the following description will be directed exclusively to the frame locking means. It should be understood that the description given for the first embodiment applies to the parts represented by the identical numerals.

The locking means in this embodiment comprises a cylindrical element 55 and a projecting pin 56 adapted to be inserted into the cylindrical element 55. The cylindrical element 55 is erected in the marginal portion of the back plate 1 substantially at right angles with the back plate 1. The inner diameter of the bore of the cylindrical element 55 is generally equal to or smaller than the outer diameter of the projecting pin 56.

The projecting pin 56 is provided on the inner side of the frame member 3 in the position corresponding to the cylindrical element 55 in such a manner that it fits into the cylindrical element 55 when the frame member 3 is turned toward the face side of the back plate 1. The number of projecting pins 56 is equal to that of cylindrical elements 55.

The locking means are generally provided in a total of eight units per frame or two units per side of the rectangular back plate 1, although the number of units can be optionally selected according to the shape and size of the picture frame.

The arrangement of the cylindrical elements 55 and projections 56 is not limited to those described above. Thus, the cylindrical element 55 may be formed on the frame member 3 and the projecting pin 56 on the back plate 1.

The mode of using the above-described picture frame is explained below.

Figure 5:
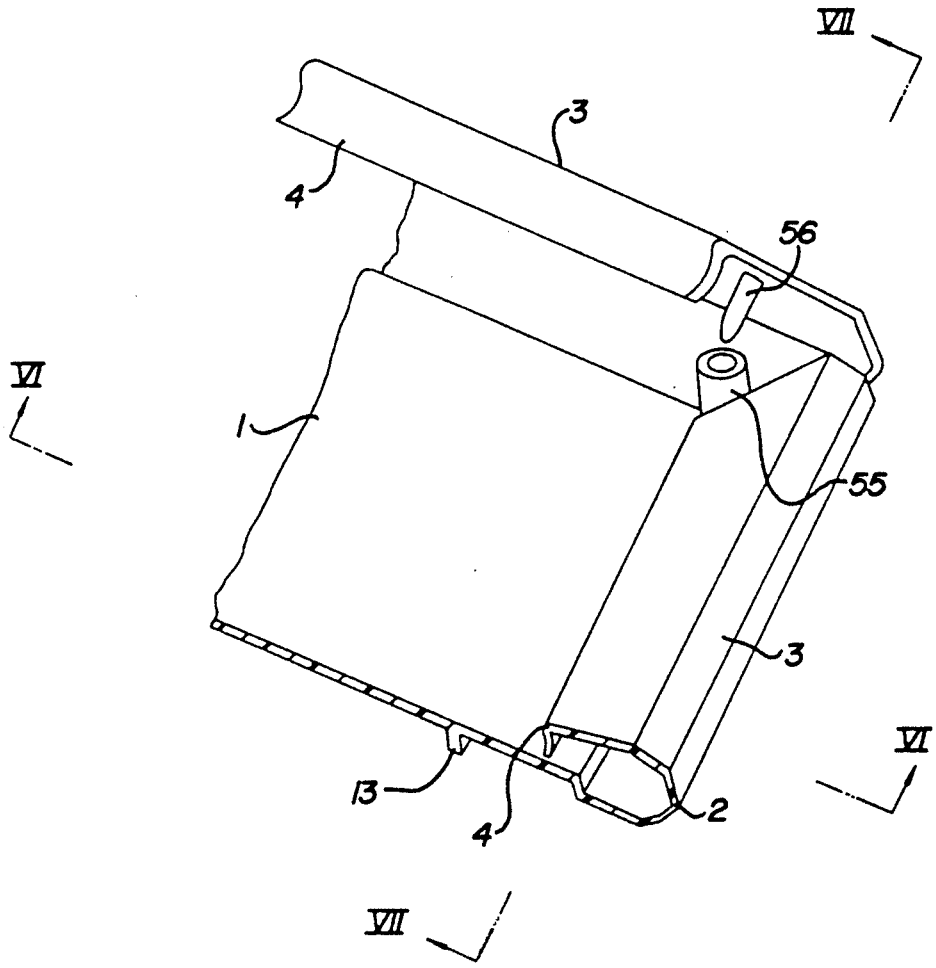
FIG. 5 is a partial perspective view showing another preferred embodiment of the invention.

First, each frame member 3 is turned outwardly about the respective hinge 2 to disengage the projecting pins 56 from the cylindrical elements 55 as shown in FIG. 5.

After the sheet 6 is placed on the face side of the back plate 1, the frame members 3 are turned in the reverse direction. Thereupon, as shown in FIG. 6, the projecting pins 56 are reinserted into the cylindrical elements 55 so that the sheet 6 is firmly held by and between the pressor members 4 and back plate 1.

While there has been described what is at present considered to be preferred embodiments of the invention, it will be understood that various modifications may be made herein, and it is intended to cover in the appended claims all such modifications as fall within the true spirit and scope of the invention.

What is claimed is:

1. A picture frame comprising the following components molded in one piece from synthetic resin: a back plate having a face side for supporting a sheet to be framed and marginal portions; a plurality of frame members disposed along said marginal portions of said back plate, said frame members having respective hinge portions connecting said frame members to said back plate and free ends opposite thereto, said frame members being rotatable about said respective hinge portions to constitute a front framework when turned toward the face side of said back plate, each of said frame members further having a pressor member formed at said free end and adapted to hold the sheet in cooperation with said face side of said back plate when said frame member is turned toward said face side of said back plate; and locking means for locking the frame members when turned toward said face said to hold the sheet between the pressor members and said face side, each locking means comprising a male member and a female member, the female member of said locking means being a hollow cylindrical element and the male member being a projecting pin which can be inserted into said hollow cylindrical element one of said male and female members being disposed on an inner side of said frame member, with the other being disposed on said marginal portion of said back plate in a position corresponding to said one of said male and female members, whereby said frame members can be secured on said sheet which is set on the face side of the back plate by engagement of said male and female members.

2. The picture frame of claim 1 wherein said hinge portions are continuously disposed along all of said frame members.

3. The picture frame of claim 1 wherein said back plate further has at least one reinforcing rib.

4. The picture frame of claim 1 wherein said back plate has a finger-hold opening.

5. The picture frame of claim 1 wherein said back plate is provided with means for accepting a stand.

* * * * *